US009294847B2

(12) United States Patent
Harman

(10) Patent No.: US 9,294,847 B2
(45) Date of Patent: Mar. 22, 2016

(54) ELECTROSTATIC LOUDSPEAKER CAPABLE OF DISPERSING SOUND BOTH HORIZONTALLY AND VERTICALLY

(71) Applicant: Murray R. Harman, Ottawa (CA)

(72) Inventor: Murray R. Harman, Ottawa (CA)

(73) Assignee: Luminos Industries Ltd., Ottawa, Ontario (CA)

( * ) Notice: Subject to any disclaimer, the term of this patent is extended or adjusted under 35 U.S.C. 154(b) by 0 days.

(21) Appl. No.: 14/179,031

(22) Filed: Feb. 12, 2014

(65) Prior Publication Data

US 2014/0233779 A1 Aug. 21, 2014

Related U.S. Application Data

(60) Division of application No. 13/451,726, filed on Apr. 20, 2012, now Pat. No. 8,670,581, which is a continuation-in-part of application No. 11/734,411, filed on Apr. 12, 2007, now Pat. No. 8,184,832.

(60) Provisional application No. 60/791,890, filed on Apr. 14, 2006.

(51) Int. Cl.
*H04R 19/02* (2006.01)
*H04R 1/26* (2006.01)
*H04R 1/32* (2006.01)

(52) U.S. Cl.
CPC *H04R 19/02* (2013.01); *H04R 1/26* (2013.01); *H04R 1/323* (2013.01)

(58) Field of Classification Search
CPC ..... H04R 2440/00–2440/07; H04R 7/04; H04R 17/02; H04R 19/04; H04R 19/005; H04R 19/00–19/01; H04R 19/013; H04R 19/016
USPC ..... 381/152, 173–176, 191, 431
See application file for complete search history.

(56) References Cited

U.S. PATENT DOCUMENTS 1,809,754 A 6/1931 Steedle
1,930,518 A 10/1933 High
(Continued)

FOREIGN PATENT DOCUMENTS

GB 537931 7/1941

OTHER PUBLICATIONS

Romer, Reiner E., "Vintage ESL Brands Repari", website located at http://loudpeaker-repair-service.reromanus.net/Other%20ESL.htm, 3 pages, printed on Aug. 12, 2013.
(Continued)

*Primary Examiner* — Suhan Ni
(74) *Attorney, Agent, or Firm* — Frommer Lawrence & Haug LLP

(57) ABSTRACT

An electrostatic loudspeaker (ESL) assembly providing curvature in two directions for improved dispersion of sound waves. The ESL comprises at least one stator panel, a flexible diaphragm and a spacer that impedes contact between the stator panel and the diaphragm. The stator is formed from a material that comprises an array of apertures. Furthermore, the material can be annealed. The material temper, along with the aperture geometry and patter, affect the stretchability of the material. The two-axis curved structure enables a compact form of ESL to be realized, including bookshelf type loudspeakers whereas all known commercial units are comparable in height to that of a human listener. The individual curved ESL panels can also be readily combined to create larger transducer assemblies including omni-directional units.

7 Claims, 17 Drawing Sheets

(56) References Cited

U.S. PATENT DOCUMENTS

| | | | |
|---|---|---|---|
| 2,615,994 | A | 10/1952 | Lindenburg et al. |
| 2,934,612 | A | 4/1960 | Stanton |
| 2,935,575 | A | 5/1960 | Bobb |
| 2,975,243 | A | 3/1961 | Katella |
| 3,008,013 | A | 11/1961 | Williamson et al. |
| 3,008,014 | A | 11/1961 | Williamson et al. |
| 3,345,469 | A | 10/1967 | Rod |
| 3,399,347 | A | 8/1968 | Martens |
| 3,668,335 | A | 6/1972 | Beveridge |
| 3,778,562 | A | 12/1973 | Wright |
| 3,892,927 | A | 7/1975 | Lindenberg |
| 4,103,155 | A | 7/1978 | Clark |
| D302,979 | S | 8/1989 | Sanders |
| 6,188,772 | B1 | 2/2001 | Norris et al. |
| 6,201,874 | B1 | 3/2001 | Croft, III et al. |
| 6,304,662 | B1 | 10/2001 | Norris et al. |
| 6,393,129 | B1 | 5/2002 | Conrad et al. |
| 6,502,662 | B1 | 1/2003 | Nakamura et al. |
| 6,535,612 | B1 | 3/2003 | Croft, III et al. |
| 6,760,455 | B2 | 7/2004 | Croft, III et al. |
| 6,842,964 | B1 | 1/2005 | Tucker et al. |
| 2002/0076069 | A1 | 6/2002 | Norris et al. |
| 2002/0122561 | A1 | 9/2002 | Pelrine et al. |
| 2003/0034903 | A1 | 2/2003 | Levin et al. |
| 2005/0094833 | A1 | 5/2005 | Bloodworth et al. |
| 2005/0147265 | A1 | 7/2005 | Smits et al. |

OTHER PUBLICATIONS

Janszen, David A., "JansZen Generations", website located at http://www.janszenloudspeaker.com/fifthGen.thm, 1 page, printed on Aug. 12, 2013.

Fig. 5a (Prior Art)
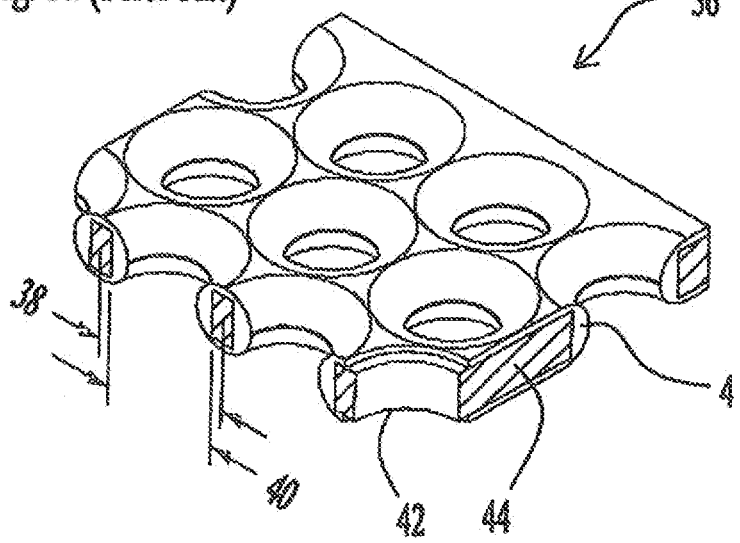
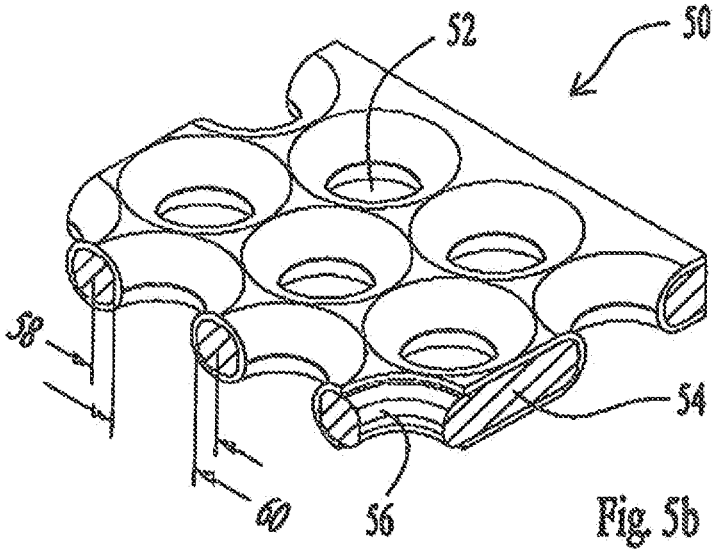
Fig. 5b

ELECTROSTATIC LOUDSPEAKER CAPABLE OF DISPERSING SOUND BOTH HORIZONTALLY AND VERTICALLY

This application is a division of U.S. patent application Ser. No. 13/451,726 filed Apr. 20, 2012 which is a continuation-in-part of U.S. patent application Ser. No. 11/734,411 filed Apr. 12, 2007, now U.S. Pat. No. 8,184,832 which claims priority benefits to U.S. Provisional Patent Application No. 60/791,890 filed Apr. 14, 2006, the enclosures of all of which are incorporated herein by reference.

TECHNICAL FIELD

The present disclosure relates to the field of electrostatic loudspeakers, and especially to a structure that is curved in two directions in order to provide ideal dispersion of sound, for example as from an effective point-source radiator.

BACKGROUND

The following U.S. Patents and Applications will be discussed:

2005/0094833 (appln.) to Bloodworth et al.;
2002/0122561 (appln.) to Pelrine et al.;
2002/0076069 (appln.) to Norris et al.;
U.S. Pat. No. 6,760,455 to Croft, III et al.;
U.S. Pat. No. 6,535,612 to Croft, III et al.;
U.S. Pat. No. 6,502,662 to Nakamura at al.;
U.S. Pat. No. 6,393,129 to Conrad et al.;
U.S. Pat. No. 6,304,662 to Norris et al.;
U.S. Pat. No. 6,188,772 to Norris et al.;
U.S. Pat. No. 3,778,562 to Wright;
U.S. Pat. No. 3,668,335 to Beveridge;
U.S. Pat. No. 3,345,469 to Rod;
U.S. Pat. Nos. 3,008,014 & 3,008,013 to Williamson
U.S. Pat. No. 2,975,243 to Katella;
U.S. Pat. No. 2,615,994 to Lindenburg et al.;
U.S. Pat. No. 1,930,518 to High;
GB Patents:
537,931 Jul. 14, 1941 to Shorter Referring to the above-listed patent documents:

Bloodworth et al. teach electrostatic loudspeaker stator panels made using a fiber-glass printed circuit board process. It discusses the difficulty of insulating punched perforated metal stator panels due to their intrinsically sharp corners and presents the use of PCB material with centrally encapsulated conductors as an alternate means of manufacturing high-performance stator panels. This patent is of interest in relation to the problem of obtaining adequate insulation on a stator panel for use at high voltages.

Pelrine et al. teach a multilayer polymer film structure that utilizes a film that is supported at close intervals and requires a bias pressure to predispose the film into small, part-spherical radiating bubble elements. Such a transducer would allow limited membrane excursion and be suited only for higher frequency sound reproduction. Reference is made to the film being deformable into different shapes such as cylindrical or spherical; however such a polymer film would require an elaborate support structure.

The Norris et al. application utilizes a sonic emitter with a foam stator having a conductive acoustic film in proximity on one side and a sparse conductive coating on the other side. A high voltage bias is then applied to the two surfaces of the foam structure causing the acoustic film to move towards the foam due to electrostatic attraction. Reference is made to the foam structure being deformable into a cylinder or even a spherical shape, although no embodiment is shown of the spherical case.

In U.S. Pat. No. 6,760,455, Croft et al. teach the use of a distributed filter within a planar electrostatic loudspeaker to decrease the effective radiating area with increasing frequency in order to maintain angular dispersion of high frequency sound waves. Croft suggests that this technique can be used to simulate an ideal spherical point source radiator. The active radiating area would have to become very small at the highest audible frequencies in order to maintain modest dispersion thereby limiting the effective radiating power at higher frequencies due to the small effective area in use.

In U.S. Pat. No. 6,535,612, Croft et al. refer to a structure and method for applying tension to the acoustic diaphragm without relying on edge tensioning. It teaches structures that provide mechanical biasing by predisposing the film into a corrugated shape. Described is a corrugated planar panel and cylindrical one-axis curved shape for improved dispersion. Croft states that "two cylindrical corrugated stators 356 create a hemispherical shape and a non-planar diaphragm 360 is arranged between the two opposing stators". The shape is similar in form to that of a beehive with sound being radiated by a discontinuous corrugated diaphragm. The Croft structure, while claiming a "diaphragm securing structure and method", would limit available diaphragm excursion and hence low frequency reproduction capability.

The Nakamura et al. speaker, although a piezo electric transducer, is of interest due to its hemispherical shape wherein the structure grows and contracts radially outward. Such a transducer would only be capable of producing higher frequencies due to limited deformation capability.

Conrad et al. depict a paper based electrostatic transducer. The form of the structure is corrugated similarly to that of Croft et al., and it also shows the identical beehive depiction as a hemispheric radiator.

In the U.S. Pat. Nos. 6,304,662 and 6,188,772 patents, Norris begins his discussion of electrostatic speakers fabricated with foam stators, which are further described in the application listed above.

Wright teaches an electrostatic loudspeaker having an acoustic wave-front modifying device and resultant polar radiation pattern. The art depicts a number of progressively angled flat facets arranged so as to provide dispersion of sound in both the horizontal and vertical planes. Furthermore, the loudspeaker is encapsulated in a dense gas that is said to provide a desired acoustic wavefront shaping and increased dielectric breakdown capability for improved power handling.

Beveridge teaches a sophisticated mechanical lensing structure to transform a planar wave front from a flat electrostatic radiator into a cylindrical wavefront with dispersion about a single axis.

Rod teaches a bendable electrostatic sheet transducer comprised of outer wire mesh stators and a centrally located electrically conductive acoustic membrane located adjacent to insulating dielectric layers. The transducer is shown in various forms including flat and cylindrical. It is also shown that the bendable sheet could be formed into a substantially continuous 360 degree surface of revolution, of cylindrical or frusto-conical form, and used to construct the shade of a household lamp having contained in its base a conventional electromagnetic loudspeaker for lower frequency reproduction. With the lamp depicted by Rod a listener would be required to maintain their ears within the projected height of the lamp shade in order to hear higher frequencies. The subject of the present application includes an embodiment of a lamp, but with improved vertical dispersion of sound waves.

Williamson, in the '013 patent, teaches a method of using a series of planar electrostatic panels and progressive delay lines so as to generate a tilted non-parallel wavefront. The patent also teaches a method of improving dispersion of high frequencies by using a second step-up transformer to drive a smaller annular section of a larger circular planar diaphragm. The '014 patent teaches similar planar panels in a zigzag configuration.

Katella teaches an electrostatic loudspeaker with an improved membrane support method. The insulating spacer panels have cut-outs that are oriented in an oblique or spiral arrangement in order to provide improved mechanical and acoustic properties as compared to square or co-axial cut-outs. According to Katella: "it is known to be important that the plates (stator panels) be definitely curved about some suitable axis or axes". No additional reference is made to the term "axes" such as in relation to modifying the dispersion characteristics of a transducer in a second vertical direction in addition to the disclosed cylindrical form, and as such the meaning of the term "axes" as compared to "axis" is thus limited to a preferred shape as would be required so as to cause the membrane to contact said spiral cut-outs. According to Katella, the stator plates 13 and 14 are formed of uninsulated metal and the vibrating membrane itself has an insulating layer on either side of a conductive core. A thick insulating layer would be required adjacent to said conductive core to enable high voltage operation and as such the insulated membrane would exhibit a reduction in high frequency reproduction capability due to increased mass.

Lindenburg teaches a diaphragm for electrostatic loudspeakers consisting of five layers having outer foil layers adjacent to inner compressible paper layers with a center insulating spacer. The structure traps a small volume of compressible air and as such, could radiate sound. The diaphragm would however be limited to very high frequency reproduction due to the limited compressibility of the thin film of trapped air. Also of interest is a figure that depicts a formed foil and paper structure that is curved about both longitudinal and vertical axis for improved dispersion of sound at higher frequencies.

In U.S. Pat. No. 1,930,518 High taught an electrostatic loudspeaker panel with a mechanism for controlling the tension and position of the diaphragm. The linear dielectric support structure used had many laterally spaced supports thus creating discrete facets that were to be tensioned using mainly the force of the electric field. In practice however, if the diaphragm were slack as it were, without sufficient tension, it could still flap back and forth between stable positions and hence affect sound reproduction. As the structure provides a series of long lineal facets it is also shown in the form of an approximated arc, as is a common present day practice for electrostatic loudspeaker panels. The patent also suggests that the structure could be used to approximate a spherical shape if the width of the facets were modified to form lunes of a sphere, although no embodiment is shown. Although the High disclosure dates from 1933 it appears that there has been no commercial use of electrostatic loudspeaker having a structure that is curved about two axes. High uses stator members of semi-conductive material, such as artificially prepared slate.

The technology in the GB 537,931 patent and many related patents form a core technology that is still in use today in designs of commercial electrostatic loudspeakers offered by the Quad Hi-fi company of the UK. These designs center around the use of a large planar diaphragm utilizing a novel stator that is subdivided into electrically isolated concentric annular regions. The audio signal applied to the annular stator regions is then progressively modified so as to cause the flat panel to emit an approximated spherical wave-front. What is of significant note is that Quad holds the claim of marketing the only full-range point source electrostatic loudspeaker and has held to this claim for about 60 years.

Although not an electrostatic loudspeaker, the Radialstrahler loudspeaker system manufactured by MBL of Germany is of interest as it provides a continuous 360-degree horizontal dispersion of sound. According to the manufacturer "The Radialstrahler concept includes a circular vertical arrangement of lamellas around an axis for each frequency range (tweeter, midrange driver and subwoofer)" A frequency range of approximately 100 to 20,000 Hertz can then be reproduced with an unique 3-way system of cooperative "football" shaped acoustic transducers, each of decreasing size for increasing operating frequency. The groups of vertically arranged curved lamellas are actuated at their respective ends in the vertical direction with electromagnetic voice coil drivers, thereby expanding radially outward and inward.

In actuality, there are several commercial ESL systems on the market utilizing flat panel radiators as well as cylindrical panels curved about a vertical axis. One company of note that offers a complete line of loudspeaker systems utilizing "line source" cylindrical ESL panels is that of Martin Logan. All of these systems are comparable in stature to that of an adult human.

SUMMARY

In overall concept the present disclosure has points of similarity to the Katella design, in having one or two rigid metal stator panels with numerous small holes, and with a vibrating diaphragm in the form of a thin membrane held out of contact with the stator or stator panels by elongated insulating spacer elements. In the present invention the stator panels and other parts are preferably provided with a compound curvature, i.e. are curved about two distinct and non-parallel axes. A notable difference over Katella is that the stator panels, while having a conductive core, are insulated over all of their surfaces, or at least those surfaces that are at all close to the membrane. Preferably, to avoid the problems outlined by Bloodworth et al., the conductive core has the corners of its holes radiused or bevelled, before the insulation is applied, so that the insulation can have adequate coverage over these corners without its thickness being too large around the mid sections of the holes, such as would undesirably reduce the hole diameter of the finished stator.

In one aspect of the present invention, there is provided an electrostatic loudspeaker assembly comprising: a) at least one stator panel in the form of a substantially rigid plate having an electrically conductive core and an insulating coating, and having its opposed major surfaces interrupted by a plurality of apertures covering a main area of the stator panel, wherein said panel is formed with: (i) a first curvature with a first axis, the first axis having a first orientation; (ii) a second curvature a second axis, the second axis having a second orientation; the first orientation having a direction distinct from the second orientation, wherein the first curvature and second curvature are independently continuous or approximated; and wherein the insulating coating of the stator panel completely covers all surfaces of the stator panel in the main area, including surfaces around the sides of the apertures; b) a flexible diaphragm generally co-extensive with the main area of the stator panel and situated in proximity to the main area of the stator panel, portions of the diaphragm being movable under the influence of electrostatic forces; and c) a spacer, formed of an insulating material, situated between the stator panel and the diaphragm which prevents contact between the diaphragm and the stator panel, the spacer comprising spacer apertures that define boundaries of the movable portions of the diaphragm; and the spacer having continuous or approximated curvature corresponding to that of the stator panel, with the proviso that: i) the stator panel and flexible diaphragm exclude paper; and ii) the apertures exclude circular holes.

The first curvature can be equal to the second curvature. Independent of the relative curvatures, where the first axis is a horizontal axis and the second axis is a vertical axis, the first curvature can be approximated with segments while the second curvature can be continuous; or the first curvature may be continuous while the second curvature may be approximated with segments; or the first curvature may be approximated with segments while the second curvature may be approximated with segments.

As discussed further below, the arrangement of the apertures, along with the temper of the material used to form the stator panel, affect the stretchability index of the material. For example, the apertures may be arranged in a hexagonal pattern or a square array. In addition, the material may be annealed. With regards to the stretchability index, the material may have an SI in the range from about 0.3 to about 0.8, or from about 0.3 to about 0.6.

The apertures of the electrically conductive core may meet major surfaces of the electrically conductive core at corners which are rounded with a radius or chamfer equivalent to at least about 5% of the thickness of the core.

In addition, the insulating coating may cover all surfaces of the main area of the stator panel, including the surfaces around sides of the apertures, and wherein apertures within the conductive core may meet one or more of the major surfaces of the conductive core at rounded or bevelled corners thereby ensuring adequate coverage of insulation on the corners.

In terms of the spacer, the spacer apertures may be defined by elongated spacer elements that have non-straight edges, such that the non-straight edges can depart from straight lines by at least 5% of a width of an adjacent spacer aperture. Furthermore, the movable portions of the flexible diaphragm defined by the spacer apertures can overlie several rows of the apertures of the stator panel.

As an example, the assembly may comprise of two similar stator panels with one stator panel on each side of the flexible diaphragm and the spacer being provided on each side of the diaphragm for separation of the diaphragm from each adjacent stator panel.

In another aspect of the present invention, there is provided a lamp comprising: a) one or more sources of illumination; and b) one or more electrostatic loudspeaker assemblies described above, wherein each electrostatic loudspeaker assembly has a compound curvature, and the one or more electrostatic loudspeaker assemblies are mounted in proximity to the one or more sources of illumination.

The lamp may further comprise a support, wherein the one or more electrostatic loudspeaker assemblies is mounted on the support, and the support includes a base which incorporates an electromagnetic loudspeaker that emits sound waves at frequencies lower than those emitted by each electrostatic loudspeaker assembly.

In yet another aspect of the present invention, there is provided an entertainment unit comprising: a) an electrostatic loudspeaker assembly described above, in the form of a surface of revolution, an exterior surface thereof being convex; b) a light source surrounded completely or partially by the electrostatic loudspeaker assembly; and c) a support, wherein the electrostatic loudspeaker assembly is mounted on the support, and the support includes a base which incorporates an electromagnetic loudspeaker that emits sound waves at frequencies lower than those emitted by the electrostatic loudspeaker assembly. The loudspeaker assembly may be formed of several stator panels joined side-by-side.

In yet a further aspect of the present invention, there is provided an electrostatic loudspeaker system comprising a plurality of electrostatic loudspeaker assemblies describe above, the plurality of electrostatic loudspeaker assemblies combined with differing orientations to provide enhanced horizontal and/or vertical dispersion.

In yet another aspect of the present invention, there is provided an electrostatic loudspeaker assembly comprising: a) at least one stator panel in the form of a substantially rigid plate having an electrically conductive core and an insulating coating, and having its opposed major surfaces interrupted by a plurality of holes covering a main area of the stator panel, wherein said panel is formed with: (i) a first curvature with a first axis, the first axis having a first orientation; (ii) a second curvature a second axis, the second axis having a second orientation; the first orientation having a direction distinct from the second orientation, wherein the first curvature and second curvature are independently continuous or approximated; and wherein the insulating coating of the stator panel completely covers all surfaces of the stator panel in the main area, including surfaces around the sides of the holes, and the stator panel is formed of annealed material; b) a flexible diaphragm generally co-extensive with the main area of the stator panel and situated in proximity to the main area of the stator panel, portions of the diaphragm being movable under the influence of electrostatic forces; and c) a spacer, formed of an insulating material, situated between the stator panel and the diaphragm which prevents contact between the diaphragm and the stator panel, the spacer comprising spacer holes that define boundaries of the movable portions of the diaphragm; and the spacer having continuous or approximated curvature corresponding to that of the stator panel, with the proviso that the stator panel and flexible diaphragm exclude paper.

BRIEF DESCRIPTION OF THE DRAWINGS

FIG. 5*a* shows a cut-away view of a prior art punched perforated metal stator panel with a dielectric coating.

FIG. 5*b* is similar to FIG. 5*a*, but shows a perforated metal sheet in which a smoothing process has been applied to the sharp edges of the apertures of the punched perforated metal before the insulating coating is applied.

DETAILED DESCRIPTION OF THE PREFERRED EMBODIMENTS

Figure 1:
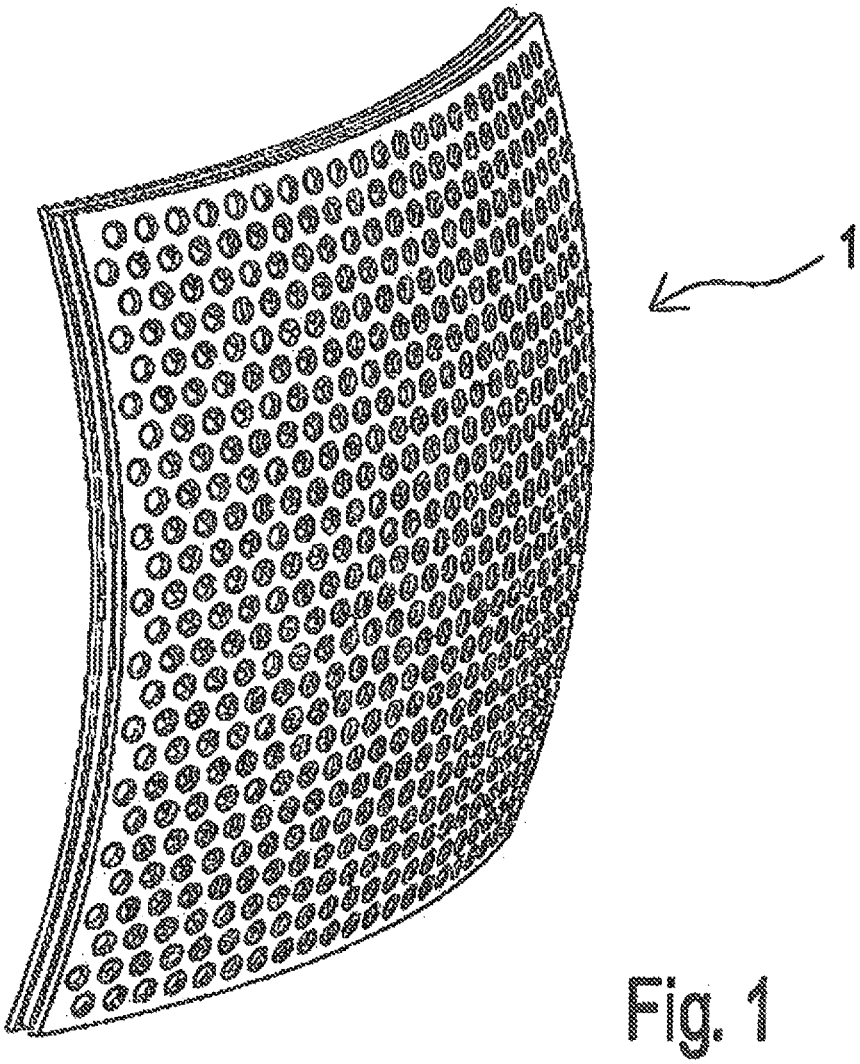
FIG. 1 shows an embodiment in which an electrostatic loudspeaker assembly in the form of a panel with curvature both in a vertical and a horizontal direction, referred to hereafter as compound curvature.

FIG. 1 shows an embodiment of a curved electrostatic loudspeaker (hereafter referred to as an ESL), having a curvature that is smooth and continuous and substantially part-spherical in shape, i.e. it is curved about two mutually perpendicular axes.

Figure 2:
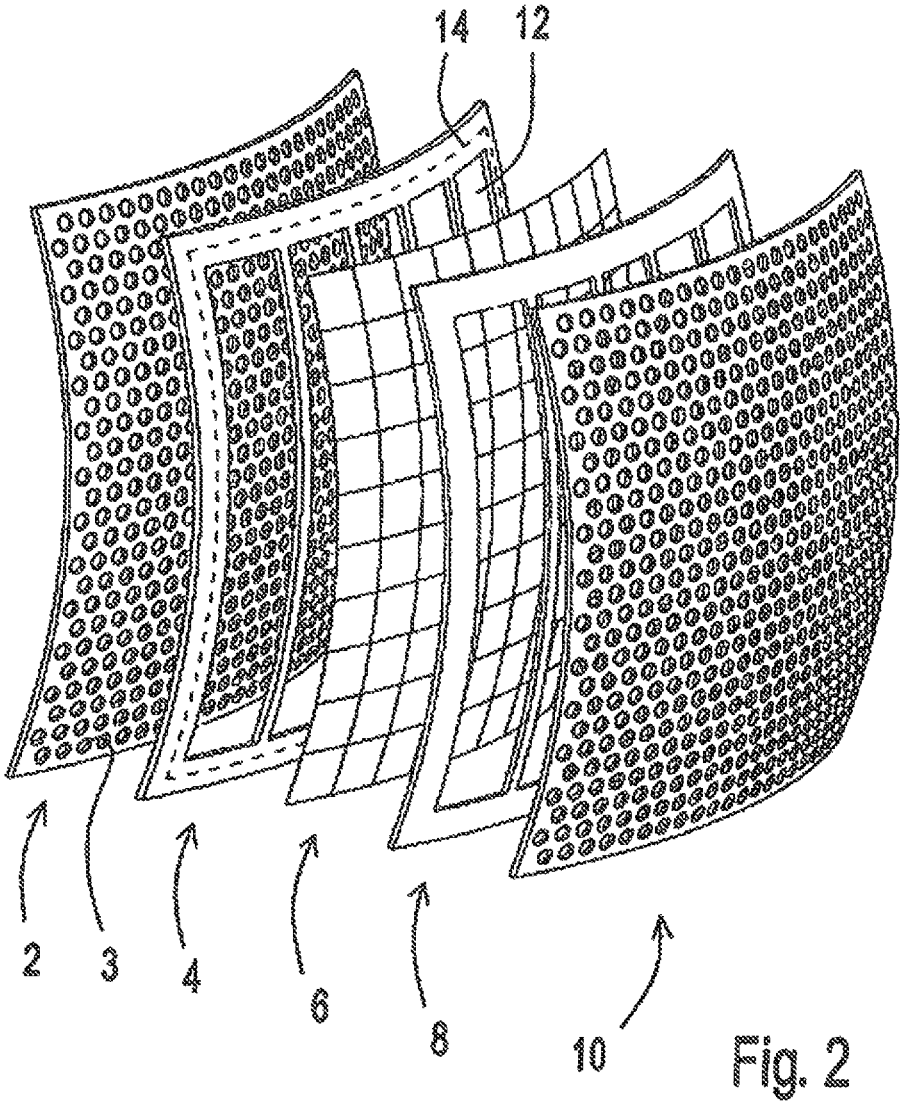
FIG. 2 is an exploded view of the compound curved panel of FIG. 1.

FIG. 2 gives an exploded view of FIG. 1 showing five of the principal layers of a typical push-pull ESL assembly consisting of inner and outer stator panels 2, 10, inner and outer dielectric spacer panels 4, 8, and a central acoustic diaphragm in the form of a thin membrane 6. A single-ended construction can also be realized by omitting and or not electrically connecting the outer stator panel 10, however a push-pull configuration is preferred as it provides greater acoustic output and lower distortion than a single-ended construction.

The stator panels 2, 10, have cores shaped from flat sheets of perforated metal sheet stock that has been deformed with a hydrostatic forming technique or two-part die set. Metal spinning methods may also be used to create a surface of revolution shape, such as a section of a sphere. In many instances the profile shape of the flat perforated panel blank is pre-adjusted so that the desired peripheral shape after forming is achieved, such as a sector of a spherical or ovaloid shape. The major surfaces of the metal sheets that form the stator panels have arrays of circular holes 3 of a number and size such that the percentage of open area is about 40-60% of the total panel area. Typically the holes are 2 to 5 mm in diameter and are spaced so that the separation between adjacent holes is approximately one half of the hole diameter. The metal cores of the stator panels, after forming, are coated with a suitable high-voltage withstanding dielectric coating such as can be applied by an electrostatic powder-coating method, as further described herein. In a second aspect the stator panel cores are moulded or thermally formed from an electrically conductive plastic with a similar geometry to the previously mentioned metal core having similar radiused or chamfered aperture edges. It would also be sound to integrate the edge radius as part of the mould tooling. Said plastic core would also be subsequently coated with a similar dielectric insulating layer. A moulded plastic stator panel design can more readily include integral stiffening ribs and mounting features. Whether a metal or conductive plastic core is used is a question of the design requirements for the specific ESL panel and where high volume production is involved the use of an electrically conductive plastic core as opposed to a metal core may be preferable.

The dielectric spacer panels 4, 8 are made of a suitable insulating material such as acrylic sheet plastic, and are formed to a similar nest-able shape to that of the stator panels, i.e. they have continuous or approximated curvature similar to that of the stator panels. They are fabricated with suitable cut-outs 12 created utilizing a laser-cutting, milling or an alternate material removal method and are thermally formed, preferably after cutting, to achieve the previously mentioned nest-able shape. Alternatively, for high volume production requirements, the dielectric spacer panels 4, 8 can be injection molded. Although the dielectric spacer panels 4, 8 are shown as continuous structures, it is also possible to create said spacer panels with discrete elements such as strips, however a continuous panel is preferred to improve integrity of the structure that will support the subsequent membrane. According to a preferred construction method, the inner dielectric spacer panel 4 is bonded to the inner stator panel 2 using a suitable adhesive such as a cyanoacrylate or a high performance contact cement. The diaphragm or acoustic membrane 6, preferably a thin tensioned plastic film such as "Mylar" (trademark), is deformed to a similar shape and stretched over and then bonded to the front curved surface of the dielectric spacer 4. The acoustic membrane has a surface treatment on one or both sides, such as a vapour-deposited metal oxide or a graphite coating exhibiting slight electrical conductivity. The value of the surface resistance can range from about 1 to 1000 Meg-Ohms per square cm depending on the requirements of the particular ESL design, so as to be suitable for distributing a uniform voltage potential or electrical charge over the surface of said acoustic membrane. The membrane is ideally trimmed at a distance from the outer edges of the dielectric spacer 4 at a spaced peripheral position 14 in order to minimize paths for electrical discharge from the edges of the conductive membrane to mounting structures, which are not shown. The outer spacer panel 8 and outer stator panel 10 are further bonded to complete the overall loudspeaker assembly as shown in FIG. 1. Not shown is the means of making the required electrical connections to energize the overall ESL assembly as the electrical connections are conventional. For the assembly to function, an electrical connection would be made to the membrane, preferably with a peripheral strip of conductive copper foil tape. Additional electrical connections are also made to the cores of the two respective coated stator panels with either mechanically fastened wires or conductive epoxy for conductive plastic cores and additionally soldered joints can be used for connecting to metal cores.

Figure 3A:
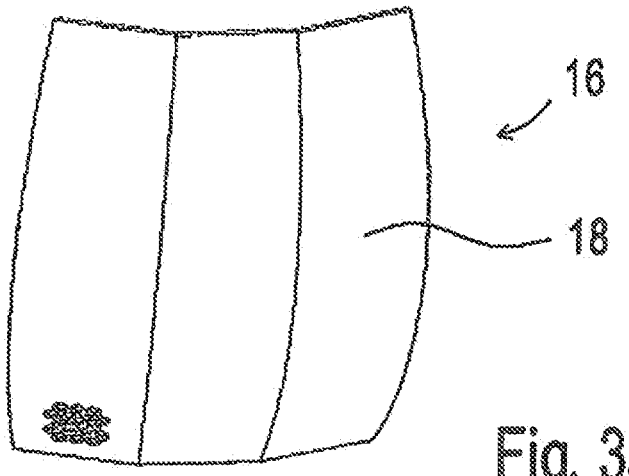
FIG. 3*a* shows an alternate compound curved stator panel similar to FIG. 1 except that curvature in one direction is approximated.

FIG. 3*a* shows an alternate preferred stator panel wherein curvature in a horizontal direction is approximated with segments that are cylindrically curved in the vertical direction. It is significant to note that if a tensioned membrane 6 as in FIG. 2 were applied to a dielectric spacer panel 4 having within it large rectangular cut-outs 12, the membrane would take the physical shape of semi-planar curved facets 18. The flatted surfaces of FIG. 3*a* would then allow for a greater unsupported width of membrane in a horizontal direction as compared to the smooth curvature of FIG. 1, which would require narrower membrane sections to prevent the acoustic membrane segments from contacting said smoothly curved stator. It would also be possible to utilize planar segments to provide approximated curvature in both a horizontal and vertical directions. In such an arrangement FIG. 3*a* would then have each curved facet 18 replaced by a number of flatted facets thus approximating an are in a second direction about a substantially horizontal axis. As such there are many possible anticipated variations of stator panel shapes that fall within the scope of the present invention, and will be understood as being covered by the term "continuous or approximated curvature about two distinct axes", i.e. non-parallel axes.

Figure 3B:
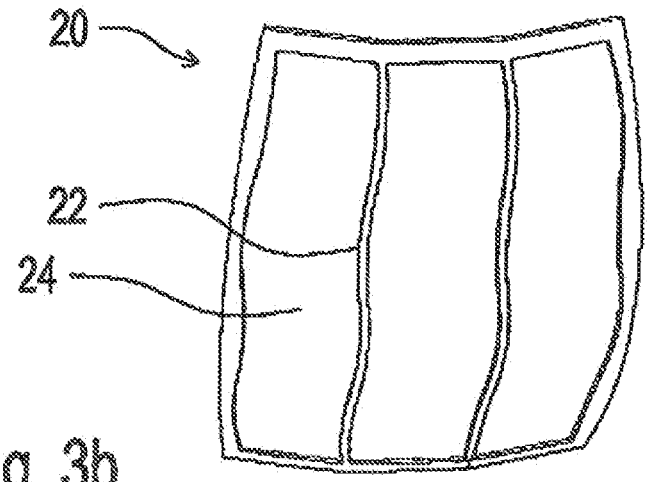
FIG. 3*b* depicts an alternate dielectric spacer panel where the boundaries of the cutouts have non-straight edges.

FIG. 3*b* shows a dielectric spacer panel 20 wherein the boundary edges 22 of the cut-outs or apertures 24 of the dielectric spacer panel 20 are contoured in order to modify the vibrational frequency and amplitude characteristics of a section of membrane as would be tensioned across an opening 24. With the use of contouring, an ESL panel can produce a more uniform acoustic output across a useable frequency range as compared to a panel with substantially rectangular cut outs as shown in FIG. 2. Through contouring, the amplitude of a given resonant peak is reduced by blending the different resonant frequencies of the varying adjacent regions of the larger overall moving membrane. Preferably the contoured edges depart from the straight lines by an amount at least 5%, and preferably about 10% of the width of the apertures 24. It may be noted that in all cases described the apertures 12, 24 are wide enough that the movable portions of the diaphragm defined thereby overlie several rows of panel holes 3; this is unlike the aforesaid High patent, at FIG. 7 of that patent, where each movable portion of the diaphragm overlies only one row of panel holes.

Figure 4:
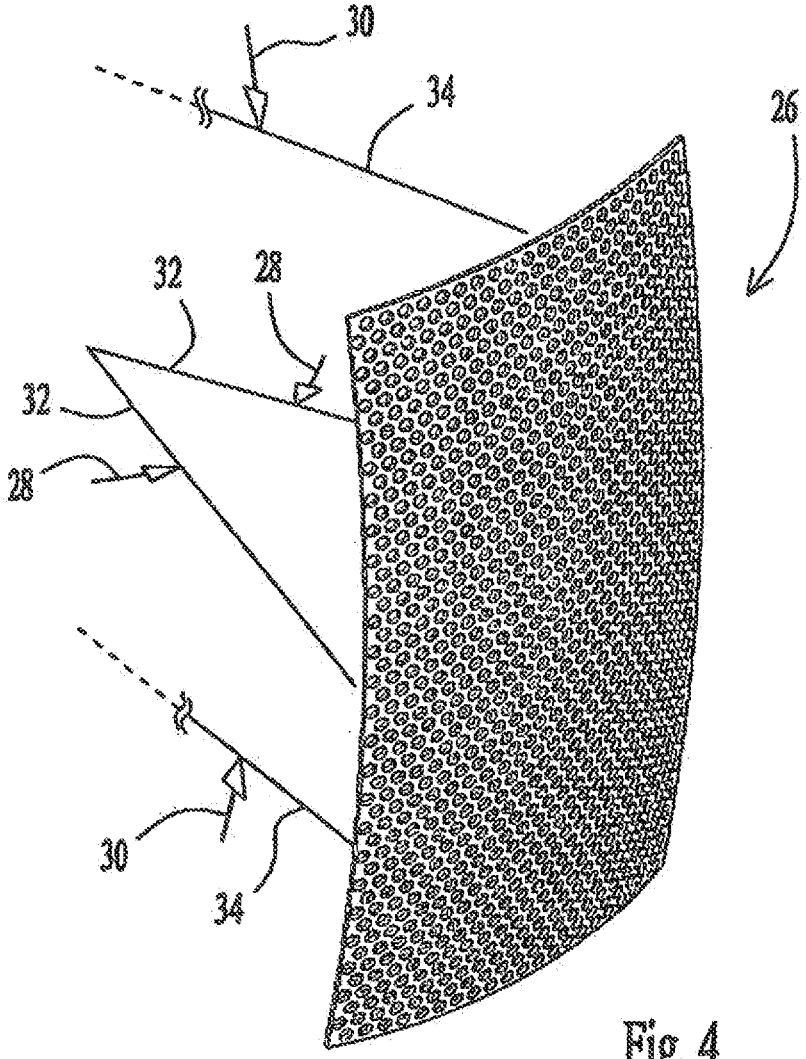
FIG. 4 is an alternate stator panel geometry having a substantially different the rate of curvature a horizontal and vertical direction.

FIG. 4 shows an alternate preferred embodiment of a stator panel 26 with different amounts of curvature in two directions as would be used to construct a similar ESL panel as FIGS. 1 and 2. A horizontal dispersion 28 of about forty-five degrees and a vertical dispersion 30 of about thirty degrees are ideal angles to disperse sound to a listener who is either reclining on a sofa or otherwise standing and located at a distance of two meters or greater. If such a panel were twice as tall as it was wide, then the radius of curvature in the horizontal direction 32 would be about one-third that of the radius of curvature vertical direction 34.

FIG. 5*a* is a cut-away section of a coated metal perforated panel 36 as would be used in a typical prior art, commercial ESL panel assembly. The difficulties associated with the insulation of punched perforated sheet materials are well known in the ESL industry and are also discussed in detail in the Bloodworth patent. A typical stator panel has about 5,000 hole-edges per square foot on one side alone. It takes but one tiny void in the coating to render the entire stator panel unuseable, and so the coating process must achieve extremely high uniformity. The sharp edges or corners of the apertures 42 of the punched perforated metal 44, where these apertures meet the major surfaces of the stator, make it very difficult to achieve a uniform covering of dielectric material 46 due to the intrinsic flow properties of the coatings. In general dielectric coatings are applied as a mist as in the case of sprayed solvent-based coatings or as a fine polymer powder as in the case of airborne powder coatings. In either case the materials must re-flow to provide a continuous void-free surface, and as such coating materials tend to flow away from sharp corners due to the effects of surface tension. One common commercial solution for manufacturing ESL stator panels involves using perforated sheet metal 44 with a high percentage of open area and then building up a thick enough coating to provide sufficient coverage over the sharp edges of the holes 42 in the perforated metal 44. As the diameter of the holes 40 increase as compared to the spacing between the holes 38, the effective free-space capacitance of the first stator panel 36 becomes reduced, when measured with respect to the adjacent electrically conductive acoustic membrane or an adjacent second stator panel as represented in FIG. 2. A reduced effective capacitance results in a reduction of acoustic output from the corresponding ESL panel. In addition, the presence of sharp hole edges 42 can cause an undesirable audible corona discharge thereby limiting the allowable bias voltage that can be applied to a corresponding ESL panel.

FIG. 5*b* is a cut-away section of a stator panel 50. It is shown with identically sized finished openings 52 as compared to FIG. 5*a*. A typical stator panel would have a thickness on the order of 0.063 inches with approximately ⅛" inch diameter holes on a hexagonal spacing of 3⁄16". In this preferred stator design, the edges of the punched holes of the metal core have been smoothed. Shown is a section view of a perforated panel core 54 with a radius at the edges of the holes 56 that is about forty percent of the thickness of the core. The application of a smaller corner radius, which may be at least 5%, or at least 10%, or at least 25%, or at least 35% of the core thickness, or an equivalent bevel or chamfer to the edges of the holes also improves the coat-ability of a perforated panel, however a maximal radius as shown in FIG. 5*b* is preferred. Detailed experiments have shown that a perforated panel core with highly rounded aperture edges is far more easily coated, with less variation in coating thickness, than a panel with sharp-edged apertures. In addition a perforated material with a lower percentage open area can be used wherein the hole-diameter 60 can be smaller in relation to the hole spacing 58 as compared to the panel 36 of FIG. 5*a*. This preferred geometry can be shown to have a higher effective free-space capacitance per unit area as compared to FIG. 5*a* due to the allowable use of smaller openings in the perforated metal. In addition if one were to map the flux lines of the electric field in proximity to the holes, the effects of flux crowding near the hole edges would be significantly reduced thereby minimizing audible corona discharge effects.

Two of the most common perforated metal sheet materials are aluminum and steel, and these materials normally require material removal techniques in order to realize edge rounding as indicated in FIG. 5*b*. Material removal methods for perforated metal panels include the use of chemical milling methods, for example, by starting with a thicker panel of about ⅛" thickness with small holes, say 1⁄16" diameter. The metal panel could then be etched to reduce said thicker panel to a more typical 1⁄16" thickness. During the process the edges are also etched and become approximately rounded. This is however a very costly process due to the limited material removal rates of chemical milling or etching. Alternately CNC milling techniques can be employed wherein a cutting tool is used to smooth the edges of the holes. Neither of these methods are very cost effective for treating large panels. It is also possible to use a swaging technique to upset or form a chamfer at the edge of the holes, for example, by locating hardened balls of about 3/16" diameter on either side of a 1/8" diameter hole and pressing the balls together until they contact. Experiments have shown that said swaging method can quickly impart a chamfer of about 0.020 width so as to approximate a curved edge. One limitation however to the application of a swaging method is the number of holes to be processed for large area panels. Other edge-smoothing techniques are known to industry, such as sand-blasting and shot-peening. Available commercial pneumatic "gun" type equipment is not suitable for providing significant smoothing of hole edges as a perforated material would become unacceptably distorted.

One approach to solve this problem was to devise a custom shot-peening machine. Perforated metal panels were loaded into a movable holder located in the bottom of a tall vertical chamber about 2-3 meters in height. Said panels were then loaded into a peripheral holder, or frame, which was then subjected to a sequential pitching and yawing motion. The panels were also flipped frequently in order to expose alternating sides. The edge smoothing was then accomplished by a uniform bombardment of peening pellets analogous to falling rain. As such any warping effects were reduced to an acceptable level by ensuring that an identical amount of metal deformation was applied to both sides of the panel. Preferably the panel was not held quite perpendicular to the impact direction of the peening pellets, at least for any substantial time, since this may cause the hole edges to be bent over forming a burred edge, rather than being rounded as required. With a peening machine in accordance to said description, it required about ½ hour to process a 2 square foot panel and during that time period about 100,000 lbs of peening media needed to be dropped as a uniform rain from a height of over 1 m onto the panel.

Preferred methods for rounding or smoothing hole edges include commercial vibratory finishing methods wherein a suitable vibratory media such ceramic balls or cylinders are used to abrade or deform a part. Ideally the vibratory media could be of an abrasive type to enhance material removal rate. It is preferable but not specifically necessary that the vibratory media be sized to allow working of the internal surfaces of the punched holes. As such, media of a large size relative to the hole-diameter will afford only a working of the outer surface and hole edges of a perforated panel. To achieve an ideal radius as depicted in FIG. 5*b*, it is preferred to use a media with a small dimension, preferably comparable in diameter to the hole diameter. As an example, balls or pins or rods of 2 to 6 mm diameter would be required for working a nominal 1/8 (3.2 cm) diameter hole opening; in this context "comparable diameter" means not more than 100% greater, or 50% less, than the hole diameter. A bin or tub type vibratory machine could be used for processing large area perforated panels. In such a machine a vibratory motion is imparted to the media through oscillatory movement of the media containment bin or tub. In vibratory finishing, the parts are generally free to circulate within the media or in the case of a large area panel they could be mounted within a frame for support to prevent the panels from contacting adjacent surfaces.

The use of a vibratory bin or tub as described above involves large amounts of energy and about 1000 or more pounds of media when relatively large panels, i.e. 1 ft.times.2 ft are to be treated. A preferred alternative vibratory method is so-called "drag finishing" where the media is principally stationary, being contained in a stationary container such as a bin or tub, and movement is imparted to the panel via a supporting frame which causes the media to move relative to the panel. The media is provided both below the panel, and above it to a depth of at least one centimeter; and preferably a depth of an inch above and below, is used. The movement imparted to the panel can be of a substantially linear or oscillatory nature. To facilitate uniform material removal around the perimeter of the hole edges and inner surfaces it is preferable to subject the panels to a circular orbital motion in the principal plane of the panel, without allowing rotation of the panel about an axis normal to said panel which would cause the material removal to be dependent on the distance of holes to this axis. A radius of orbit comparable to the hole size is preferred to allow the media to enter the inside of the holes. The concept of an "orbital drag" method as defined herein is not typically available in a commercial vibration finishing machine and as such a custom machine was designed with a support frame and motor drive to impart said orbital motion. Significantly high media impact forces can be achieved with said orbital drag method and a practical cycle time can be achieved. In a test using about 55 pounds of 2 mm diameter abrasive ball media, having a depth of 2 inches above and one inch below an aluminum panel having 1/8 inch diameter holes, and using a fixed orbital motion with a 2-3 mm radius at about 1800-3600 rpm, suitable treatment of holes 56 was achieved in about 2-3 hours. Commercial bin-type vibration finishing machines which rely on movement of the bin, as described above, generally require multiple days to achieve a similar result. A fixed linear oscillating motion can also be used instead of a fixed orbital motion provided the direction of motion is randomized so as to provide working of the entire edge of the hole. The types of motion which can be used are further described below with reference to FIGS. 10*a*, 10*b* and 10*c*. Combinations of the peening, and the abrasive method, can also be used.

In addition to chemical etching methods mentioned previously, electrochemical machining (ECM) methods can be used wherein a perforated plate electrode is used with an electrolyte in the presence of electric current to selectively remove sharp features. Said perforated plate electrode would typically have projecting features that are aligned with the axis of each hole, having a geometry so as to concentrate current flow near hole edges. Although ECM can be used to generate an ideally rounded edge feature such as shown in FIG. 5*b*, it is not ideally suited for processing large area panels due to prohibitively high operating costs for said ECM machines. Alternately if an electrically conductive plastic or die-cast metal is used to form the perforated stator panel core then rounded edge features can be created as part of the moulding process and an edge rounding process is not specifically required.

Figure 6:
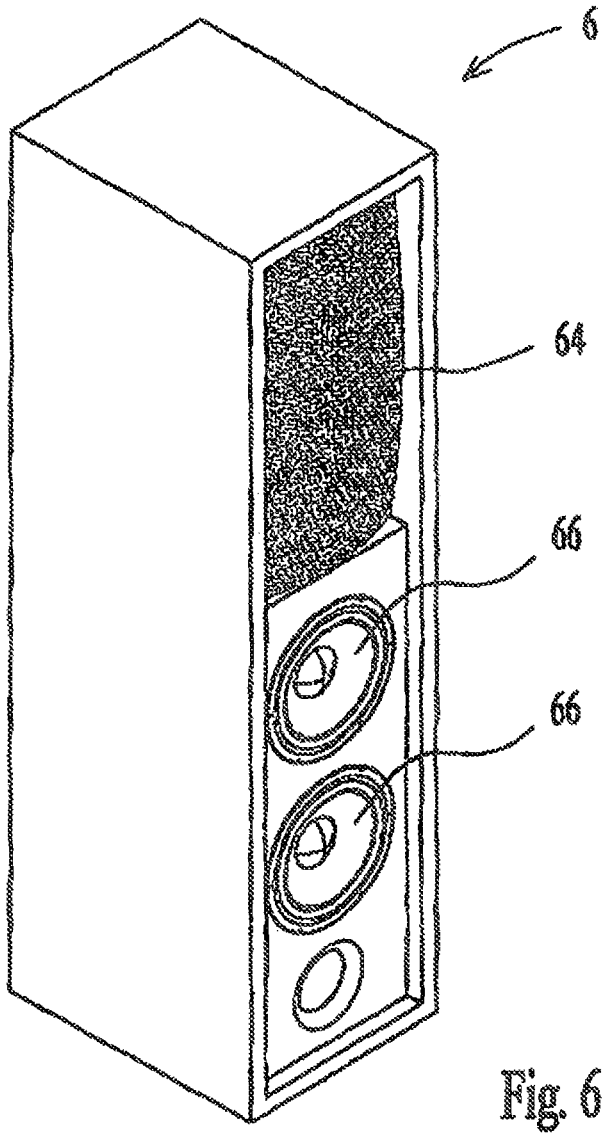
FIG. 6 is an embodiment of a full-range hybrid loudspeaker utilizing a compound curved ESL panel for the higher frequencies and conventional electromagnetic loudspeakers for reproduction of the lower frequencies.

FIG. 6 shows a depiction of a two-way hybrid ESL system 62 of a compact type as would be used in a typical home audio application. The use of a compound curved ESL panel 64 would allow the system to be constructed in a comparable sized format to a conventional electromagnetic type loudspeaker system of the order of two to three feet tall. The lower frequency ranges would be generally be reproduced with an electro-magnetic voice-coil type driver shown as a pair of said drivers 66.

Figure 7:
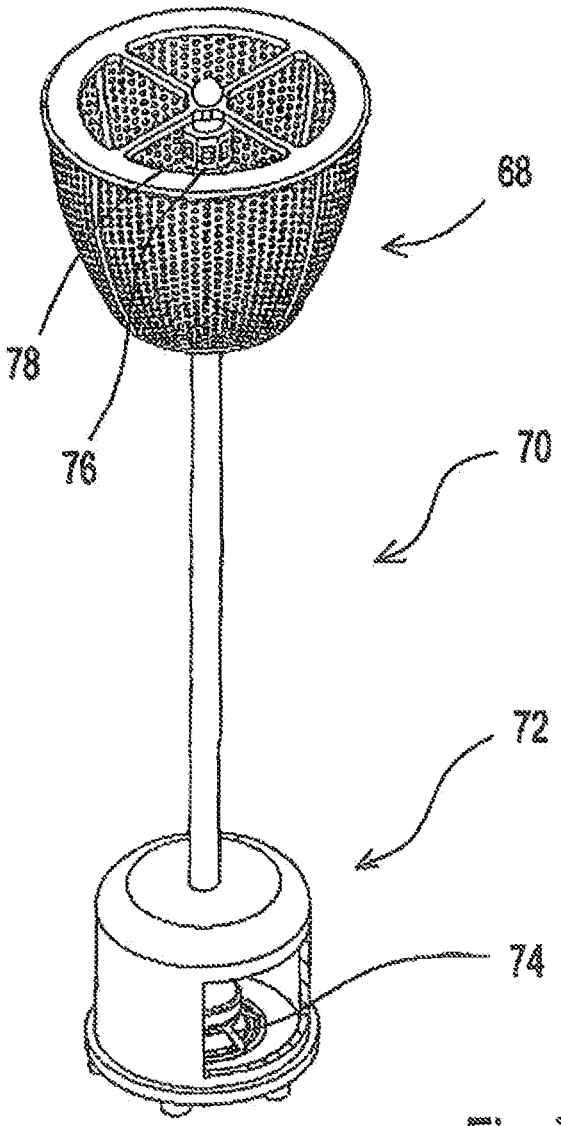
FIG. 7 is shows a 2-way hybrid loudspeaker in the form of a floor lamp.

FIG. 7 is an example of how a number of compound-curved ESL panels could be assembled as a light shade 68 and used in the construction of a lamp 70 that is both a high-quality loudspeaker and an attractive functional lamp. Whereas the majority of conventional loudspeakers are in the form of a rectangular box, a compound-curved ESL panel allows the creation of shapes that can be integrated into other non-traditional forms. For example, an ESL lamp-shade 68 constructed of multiple panels, as shown, would provide for dispersion of sound in the vertical direction, unlike the cylindrical shade shown in the aforesaid Rod U.S. Pat. No. 3,345,469. Shown integrated into the lamp 70 is a base portion or housing 72 that contains an electromagnetic voice-coil type driver 74 used for reproduction of the lower frequency ranges. In said lamp 70, a completely separate commercially available sub-woofer type unit could also be used, which could thusly eliminate the need for the housing 72 and driver 74. If the shade 68 were cut vertically in half it could itself become a decorative wall sconce that is both a lamp and an ESL panel in disguise. A usable lighting function can be realized with the addition of suitable florescent or incandescent lamps; however a preferred embodiment includes the use of high-brightness chip-type light emitting diodes (LED's). Such chip LED's 78 are shown mounted onto an octagonal block 76 suitable for dissipating excess heat. Alternately the lighting elements could be spaced in a vertical linear manner allowing the centre pole of the lamp to be used as a heat sinking member similar to the aforementioned block 76. At the time of writing of the present patent application, chip type white LED's on the order of one to two cm in size with an output of 100 to 500 lumens were available, having efficiencies equal to or exceeding that of high-performance incandescent halogen lighting.

It is anticipated that LED lighting technology will continue to advance rapidly, and enable the creation of numerous types of decorative structures including lighting and other architectural designs that would benefit from the use of a compound curved ESL panel as a disguised acoustic transducer. The ESL panels 68 are suitable for use as a light shade material as the apertures of the stator panels comprise a significant percentage of the total panel area, typically thirty to fifty percent, and in addition the membrane itself is generally transparent or translucent depending on the applied conductive coating, and as such would allow a controlled amount of light to pass. Also, if a suitable reflective outer coating were used on the surfaces of the stator panels adjacent to the light source, then the reflected portion of light that did not pass through the aforementioned apertures would also provide illumination.

Figure 8:
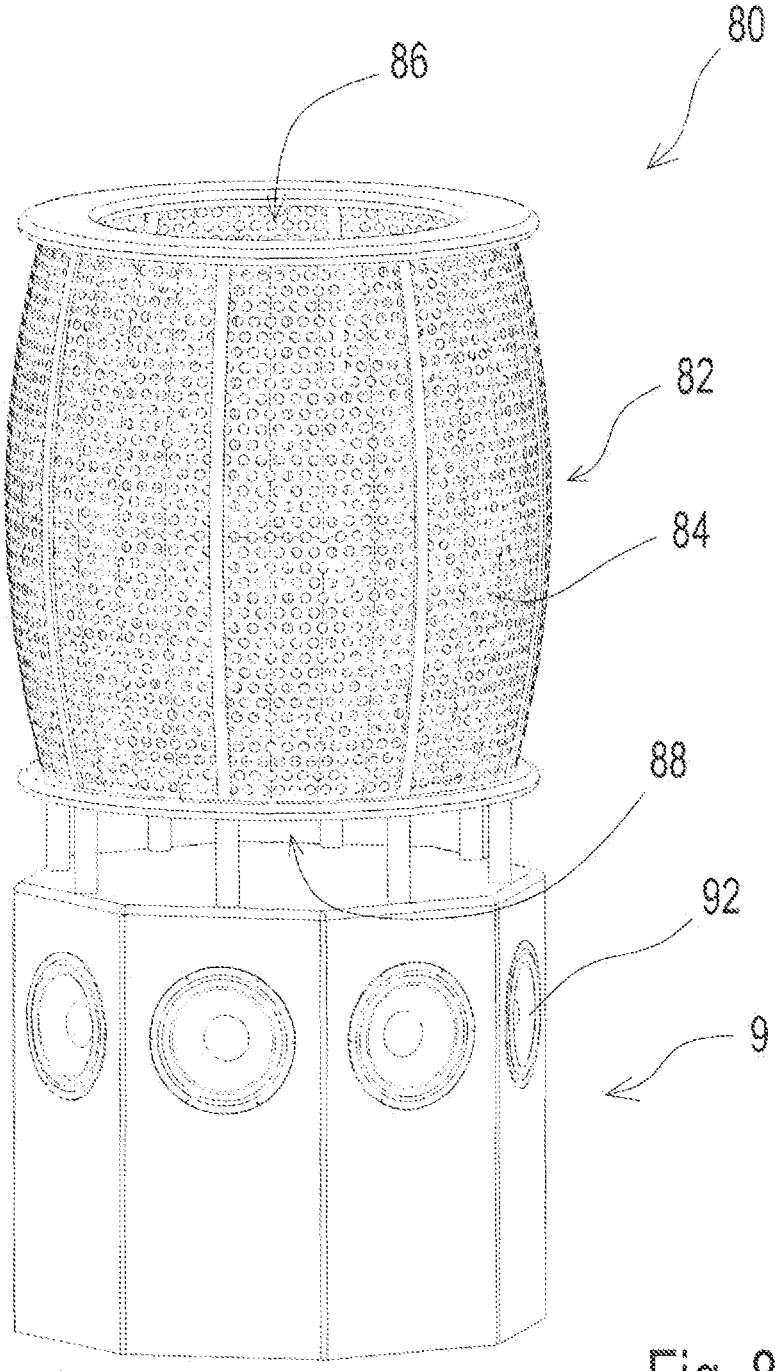
FIG. 8 is shows a 2-way hybrid loudspeaker utilizing an omni-directional ESL assembly.

FIG. 8 is an embodiment of an omni-directional loudspeaker system 80 wherein an ESL system 82 is comprised of a number of compound curved ESL panels 84. The ESL system 82 as shown provides continuous 360 degree horizontal dispersion and about thirty degree vertical dispersion of sound waves. Such a system would have an inherent advantage of providing a listener with a mental focal image of an emerging sound wave unlike a cylindrical ESL radiator that provides a line source image. The ESL system 82 has end openings 86, 88 to minimize backpressure on the moving acoustic membrane that would otherwise limit travel of said membrane at lower frequencies. The ESL system 82 as shown could otherwise be constructed with closed ends, however this would result in reduced low-frequency response due to the limited compressibility of the trapped air. An ESL system 82 on the order of two feet in diameter as depicted could reproduce frequencies down to about 200 Hz. As such a low frequency transducer unit 90 is added wherein a number of electro-magnetic voice-coil drivers 92 are used to reproduce frequencies below 200 Hz. It is also possible to utilize other driver typologies for the low frequency transducer unit 90, for example, a larger down-firing driver with or without a number of radially arranged bass-reflex ports. If a similar system were built on a larger scale it would then be quite suitable for use in commercial sound reinforcement applications in large venues such as public theatres or halls. In such a case a similar unit would likely be suspended from the ceiling and be of the order of ten to twenty feet in diameter.

Figure 9:
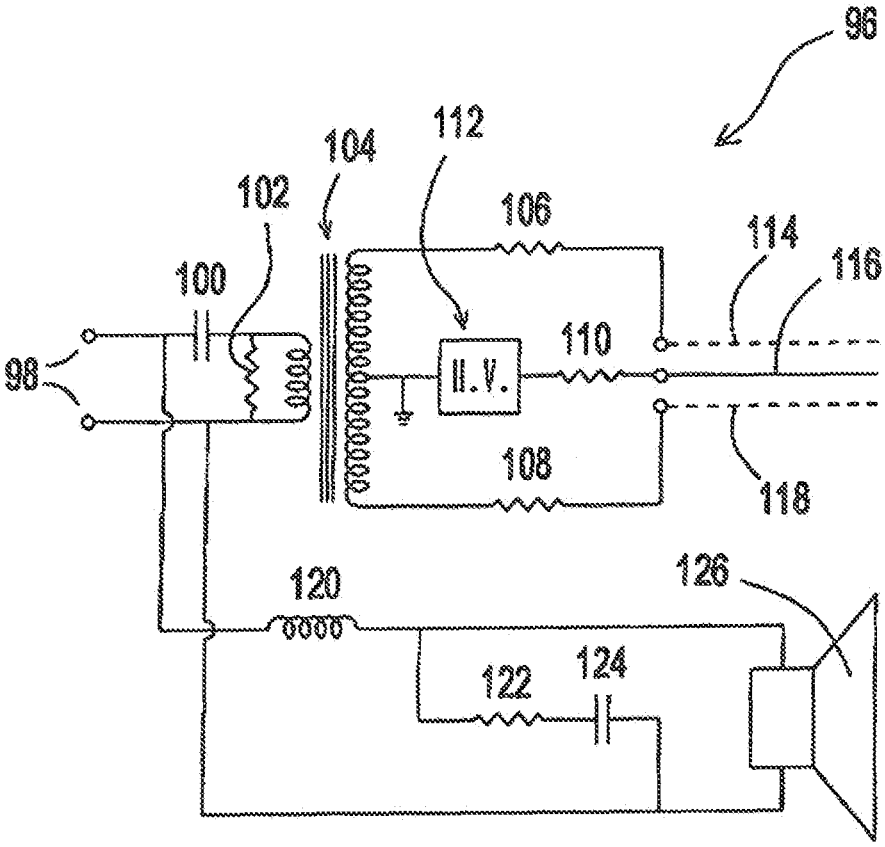
FIG. 9 shows a example of an electrical drive circuit for a 2-way hybrid loudspeaker having an ESL panel and conventional electromagnetic voice-coil driver.

FIG. 9 is a simplified circuit diagram as could be used in a two-way hybrid electrostatic loudspeaker system. A suitable audio amplifier having low impedance drive capability is connected to the audio inputs 98. A first capacitor 100 and resistor 102 form a high-pass filter with a typical corner frequency at about 200 to 500 Hz depending on the frequency response of the corresponding ESL panel assembly connected. The step-up transformer 104 has a step up ratio on the order of 1:50 to 1:100 in order to provide a high-voltage audio signal suitable for energizing of the stator panels. Resistors 106, 108 are used to adjust the high frequency response characteristics of the ESL panel assembly and connect to the perforated stator panels represented as dashed lines 114, 118. A high voltage DC supply 112 provides a bias voltage on the order of 3-6 kV depending on the dielectric withstanding capability of the respective ESL panel. Resistor 110 is used to limit the maximum current available the membrane 116 and to form an intrinsic resistor-capacitor low-pass filter with the self-capacitance of the ESL panel assembly. In accordance with FIG. 2 stator panels 2 and 10 would respectively be 114 and 118; the electrically conductive acoustic membrane 6 would then be 116. A typical value for the resistor 110 would be 10 Meg Ohm and the self-capacitance of a typical ESL panel assembly would be on the order of 1 nano-Farad and would provide a frequency corner of less than twenty Hz, which is far below the operating frequency range of the respective ESL panel. An inductor 120 and a low-frequency driver 126 form a low-pass filter. A series resistor 122 and capacitor 124 provide impedance equalization of the intrinsic self-inductance of the low frequency driver 126.

In FIGS. 6, 7, 8, 11 and 13 the ESL panels are represented by a single stator panel for clarity and would in practice be constructed according to a preferred push-pull configuration as depicted in FIG. 2.

Figure 10A:
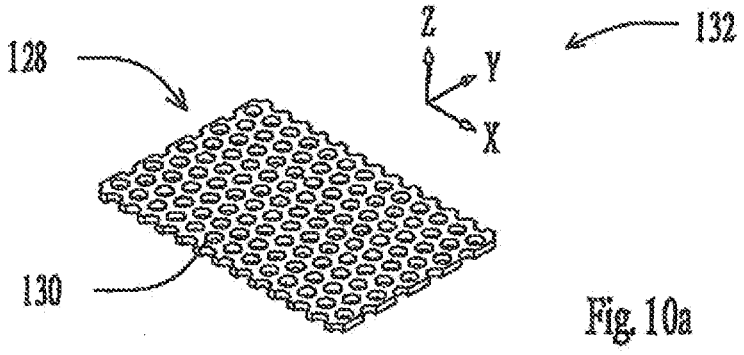
FIG. 10*a* shows a sample of perforated panel material.

FIG. 10*a* shows a sample of perforated sheet material 130 as would be processed to form a perforated metal core 54 with rounded edges 56 as in FIG. 5*b*. When utilizing an orbital drag method in conjunction with vibratory media for rounding the edges as defined herein, the perforated material 130 would be subject to movement principally in the XY plane as defined by the axis designator 132. Said movement would consist of a planar translation without significant rotation about the Z axis 132 so as to ensure each section of the material 130 is subject to an identical trajectory.

Figure 10B:
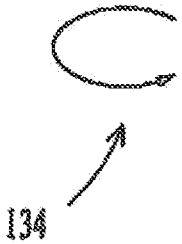
FIG. 10*b* shows a circular orbit referenced to movement of FIG. 10*a*.

FIG. 10*b* is representative of a circular movement in the XY plane 134 wherein no rotation occurs about the Z Axis 132, for example at a radius of movement of 2-3 mm at a rotational rate of 1800 to 3600 rpm. The rotational movement vector is shown enlarged relative to the hole size which is nominally about ⅛ inch (3.2 mm). This represents 30 to 60 cycles per second; however it is believed that any speeds from about 5 to 200 cycles per second, or more may be effective. As speed of said movement is increased a typically smaller radius of movement is required to achieve comparable rates of material removal due abrasion.

Figure 10C:
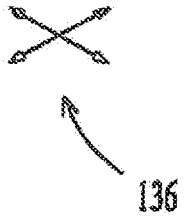
FIG. 10*c* shows a multi-axis linear motion referenced to movement of FIG. 10*a*.

FIG. 10*c* is representative of a linear movement in the XY plane 136 wherein the sample 130 would be subject to alternate linear oscillatory movements for example movements of 2-3 mm peak in at about 30 to 60 cycles per second, alternating between an X and Y direction. Additionally three linear oscillatory movements arranged at 120 degree intervals can be ideally used to align with a hexagonal hole pattern. The linear movement vector is shown enlarged relative to the hole size which is nominally about ⅛ inch (3.2 mm).

Figure 11:
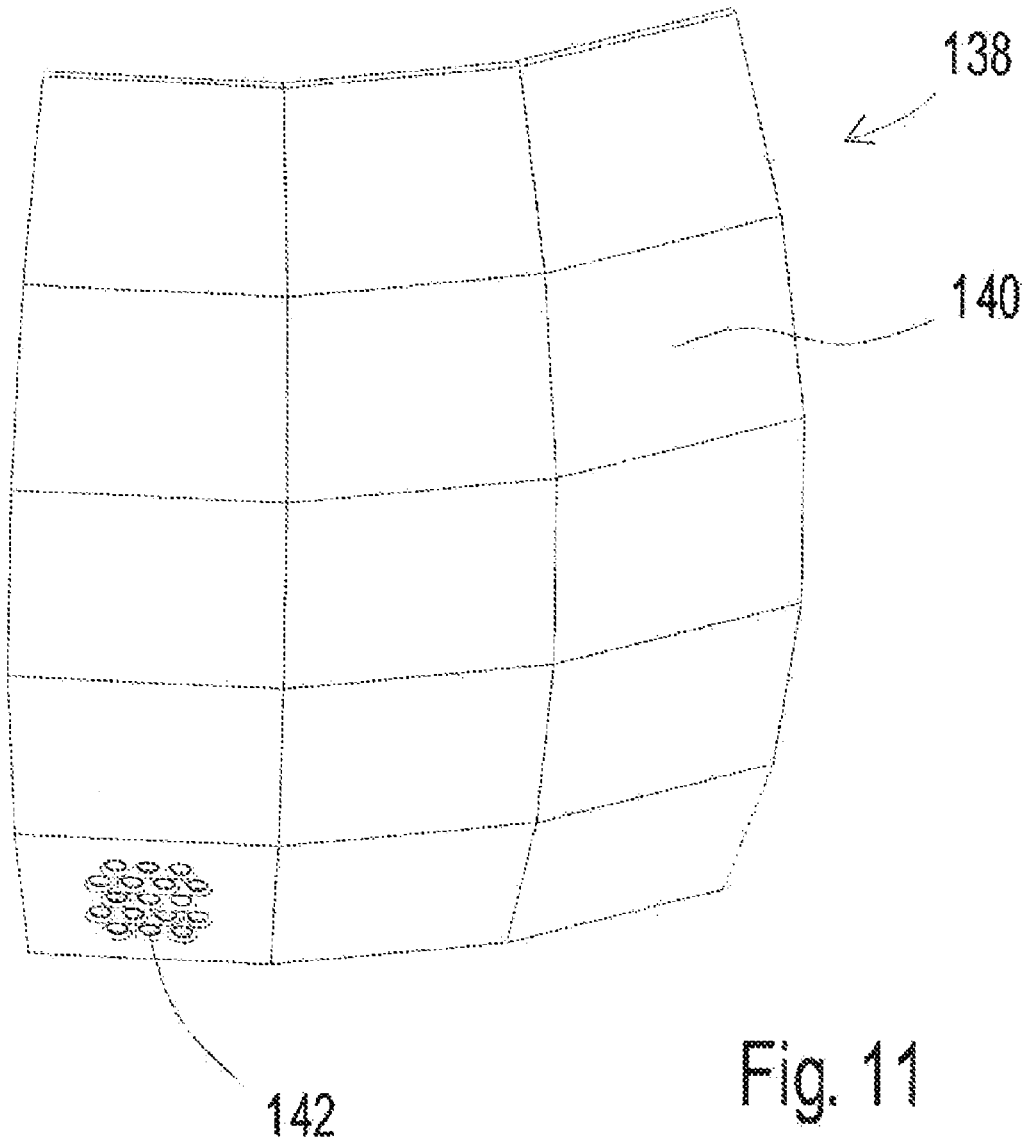
FIG. 11 shows a compound stator panel similar to FIG. 3*a* except that the curvature of the panel in two distinct axes is realized with flat facets.

FIG. 11 shows a stator panel 138 made up entirely of flat facets 140 having apertures 142 which may be round or have other suitable shapes such as, but not limited to, slots. In this arrangement, the movement of the acoustic membrane is quite linear with an identical tension characteristic for both an inward and outward movement. The facets 140 are arranged with a small angular deviance between adjacent facets in order to ensure a uniform sound pressure resultant within any vantage point in two axes that are approximately normal to the approximated compound surface circumscribed by said facets. The allowable angular deviance between adjacent facets in either axis tends to reduce with increasing frequency so as to avoid an objectionable or audible variation known in the ESL industry as a picket fence intensity characteristic.

Figure 12A:
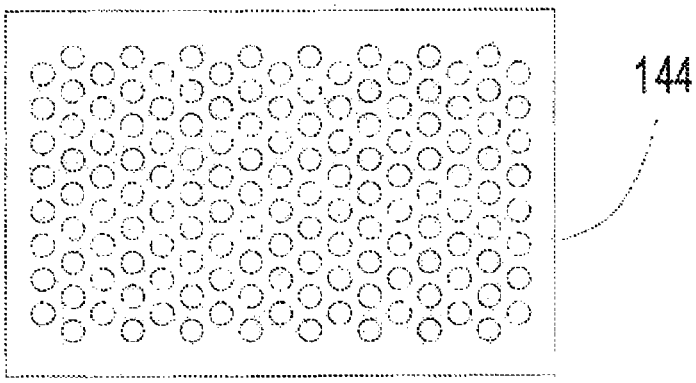
FIG. 12*a* shows an arrangement of apertures in a sample of perforated sheet material, depicted as round holes arranged in a closed pack hexagonal configuration.

FIG. 12*a* shows a common pattern of commercial perforated sheet stock 144 with round hole-shaped apertures arranged in a uniform closed-pack hexagonal pattern. The amount a particular pattern can stretch without rupturing is greatly affected by the initial geometry and placement of the apertures. The amount the sheet stock can be stretched (without tearing) is also affected by the condition of temper of the sheet stock; annealed materials are generally able to realize the greatest percentage of stretching prior to tearing. To facilitate comparison between different shapes and placements of apertures, the term SI will be defined herein as the Stretch-Ability Index where an equivalent non-perforated sample would be defined as having a SI equal to unity. SI is then defined as the overall strain that a perforated sheet sample can sustain up to the point of fracture divided by the fracture strain limit of a similar non perforated sample. The pattern as shown in FIG. 12*a* has an SI of approximately 0.3.

Figure 12B:
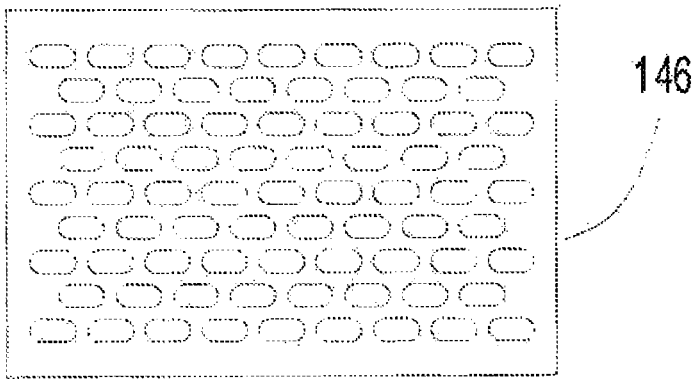
FIG. 12*b* shows an alternate shape of apertures which are shown as slots, arranged in an alternating grid pattern.

FIG. 12*b* shows a perforated sheet sample 146 with oval shaped apertures which can be advantageous over round holes, in allowing a greater degree of deformation of the material when forming a continuous sheet into a one-piece multi-facet stator panel. Sheet sample 146 has an SI of approximately 0.4. The exact shape and layout of the apertures is not critical and is understood to include other shapes in addition to circles and ovals as well as other spatial arrangements of the holes.

Figure 12C:
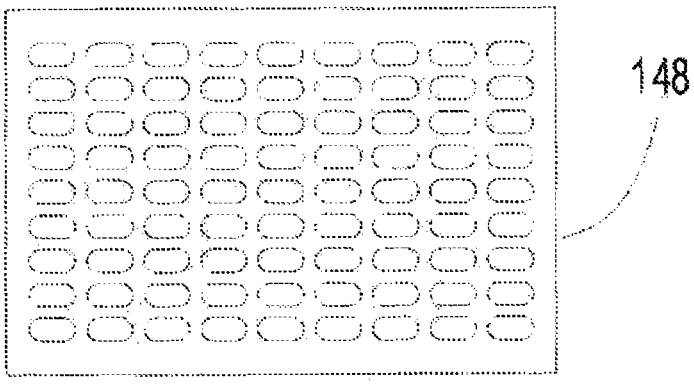
FIG. 12*c* shows an alternate arrangement of apertures, arranged in a uniform grid pattern.

FIG. 12*c* similar to FIG. 12*b*, shows a perforated sheet 148 with an array of slotted apertures, arranged in a regular grid pattern to allow increased deformation in a desired direction without tearing or damaging the panel. In this configuration a greater volumetric percentage of metal is subject to maximum strain resulting in an increased stretch-ability index or SI, of approximately 0.5 to 0.6. The Exact SI for a given pattern will vary with material properties and aperture geometry; numerical values of SI are provided for comparison purposes only. In general, a perforated sheet stock can be in an annealed condition for maximum stretchability. For example a typical 3003-H14 grade aluminum sheet in an as-rolled temper can withstand about 20% elongation at rupture. That same material, in an annealed condition (for instance 3003-0) can withstand 40% elongation or more at rapture.

Figure 13:
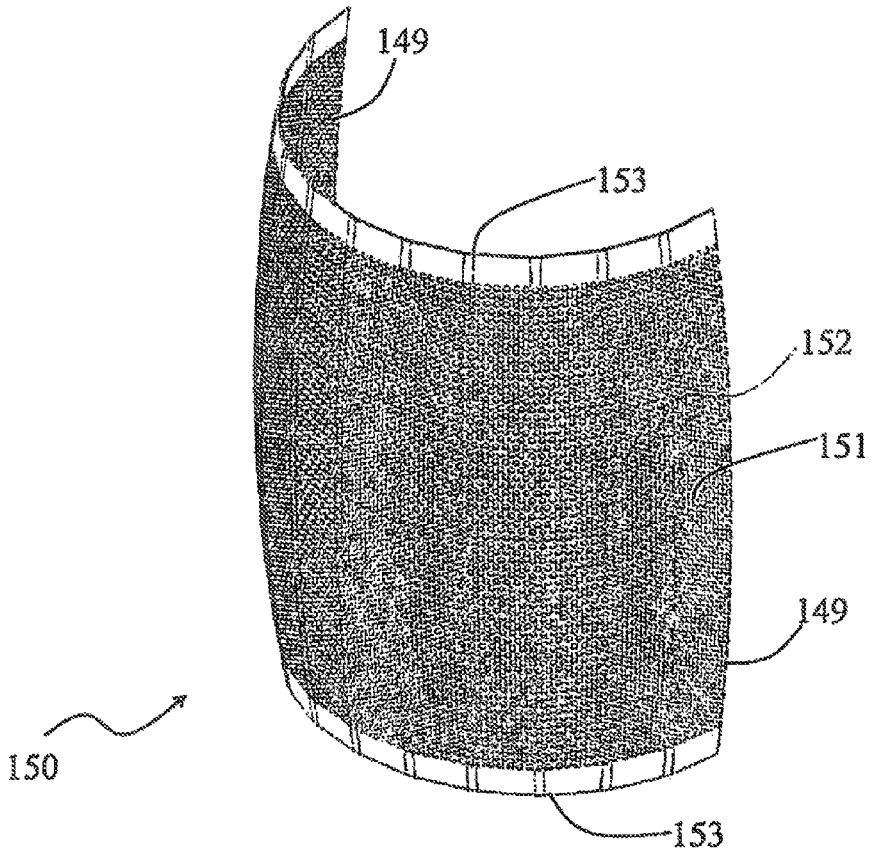
FIG. 13 shows a perforated stator panel similar to FIG. 3*a* and FIG. 8 formed of many curved facets, in which two of panels are assembled to make an omni-directional ESL assembly.

FIG. 13 shows a stator panel 150 that may be used to make an ESL that projects sound with a very large horizontal dispersion while maintaining a controlled vertical dispersion. In the example shown, sound may be projected over approximately 180 degrees of horizontal dispersion. The radius 151 at the centre of the panel 150 is about 10% larger than the radius at top and bottom edges 153. Formation of this panel is accomplished with a perforated material that can withstand up to 10% overall plastic deformation without tearing. A typical stock 3003-H14 aluminum material with a hexagonal pattern 144 (as in FIG. 12*a*) has a plastic limit of about 20% with an SI of about 0.3, thereby allowing an overall stretching of about 6% at rupture. If the same panel is instead formed with an annealed material having a plastic limit of 40%, the allowable overall plastic deformation increases to about 12%, based on an SI of 0.3; the panel can therefore be formed without tearing.

It is also possible to form the stator panel 150 with stock 3003-H14 material having an aperture form with a higher SI. For example, the stator panel 150 can be formed using material with, for example, elongated apertures 148 as shown in FIG. 12*c*.

Therefore, aperture form, aperture spacing, and annealing affect the overall plastic property of the material used to form the stator. Annealing, however, can often be a more cost effective method for increasing material deformation capability than aperture shape and/or spacing due to the costs associated with specialty punch press tooling for custom perforation of noncircular apertures.

Other metals such as low carbon sheet steel can also be used for stator panels and can also typically be used in an annealed state to increase deformation capability prior to tearing of the material. Whereas FIG. 8 depicts an omni-directional loudspeaker assembly comprised of many small ESL panels held in individual frames, the example shown in FIG. 13 illustrates a stator of suitable geometry to realize an omni-directional ESL having a fall 360°-horizontal radiation pattern, with as few as two ESL panels. The 180°-form thereby reduces the complexity of the mounting frame and allows all facets 152 to be formed from a single acoustic diaphragm, thereby allowing for increases efficiency of assembly and uniformity of tensioning of the diaphragm, as compared to the embodiment shown in FIG. 8.

Formation of a single larger stator panel 150 (compared to individual smaller panels 84) requires use of a material that can withstand a larger overall plastic deformation without tearing. The use of annealed metals and/or preferred aperture geometries with a high SI, enables the fabrication of stator panels with significant curvature about a second axis. A compound curved stator panel 150 can be formed by first clamping the sheet material along, or near, edges 149 that are substantially parallel to a cylindrical axis, followed by expanding the sheet material radially outwards using a hydraulic press. As an example, the hydraulic press can include series of rams, each ram having a curvature corresponding to desired final curvature about two distinct axes. The rams are moved in a synchronized fashion, radially outward from the centre of the clamped sheet, thereby stretching the sheet metal to the final desired specification. Once formed, the stator panel is far more stiff compared to a one-dimensional curved sheet formed by using a conventional rolling or progressive bending technique.

Figure 14:
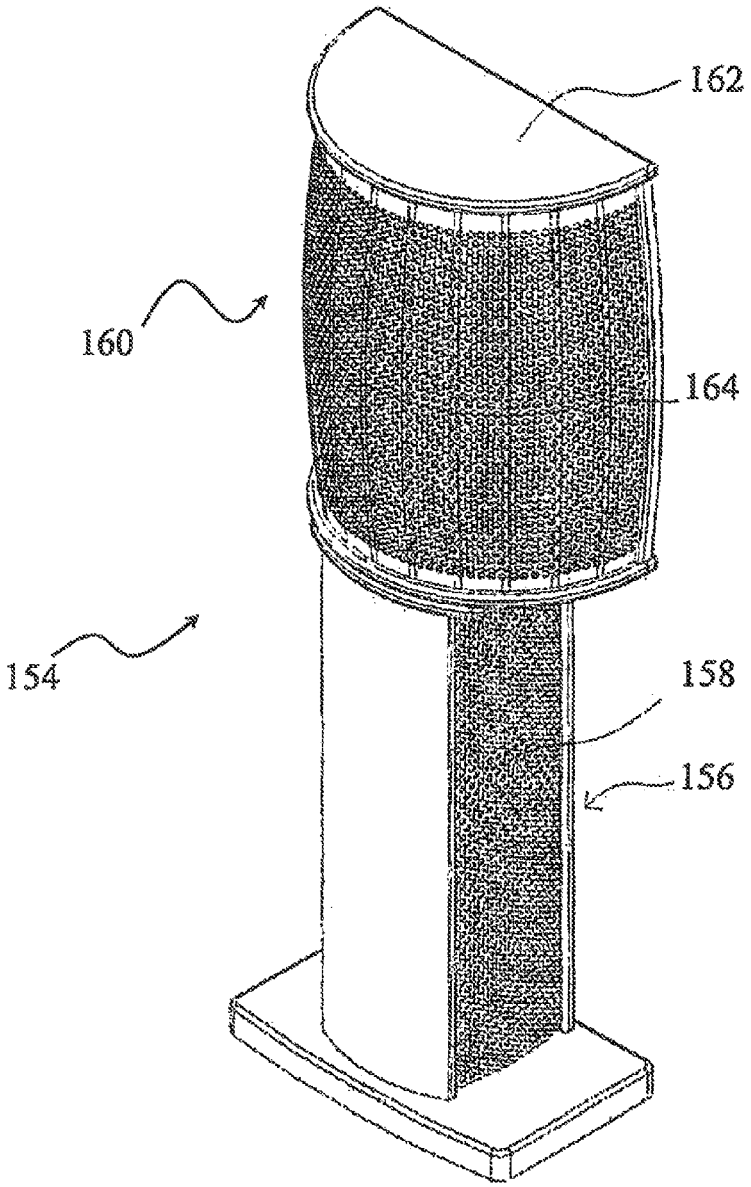
FIG. 14 shows a 180°-horizontal dispersion hybrid ESL panel assembly with dynamic cone type woofers used to re-enforce the lower frequency range.

FIG. 14 is an embodiment of a hybrid ESL-180 loudspeaker 154 with a supporting stand 156 that contains low frequency transducers (or "woofers") 158. The term Hybrid is a term common to the ESL speaker industry that implies a combination of ESL transducers and electromagnetic voice coil and cone type low-frequency woofers. The woofers are ideally arranged in an opposing configuration to avoid transmitting vibrations to the ESL panel through the mounting frame. Of course other woofer configurations can also be implemented with success such as a traditional front-firing alignment. In the embodiment shown in FIG. 14, the ESL panel assembly 160 has a 180°-horizontal dispersion. The ESL panel assembly 160 is housed in a sealed enclosure 162 to provide improved low frequency response by eliminating the dipole cancellation effects of the rear acoustic wave of the panel interacting out of phase with the front acoustic wave of same said panel. The ESL panel 164 can also be mounted in a frame with an open back if so desired.

Figure 15:
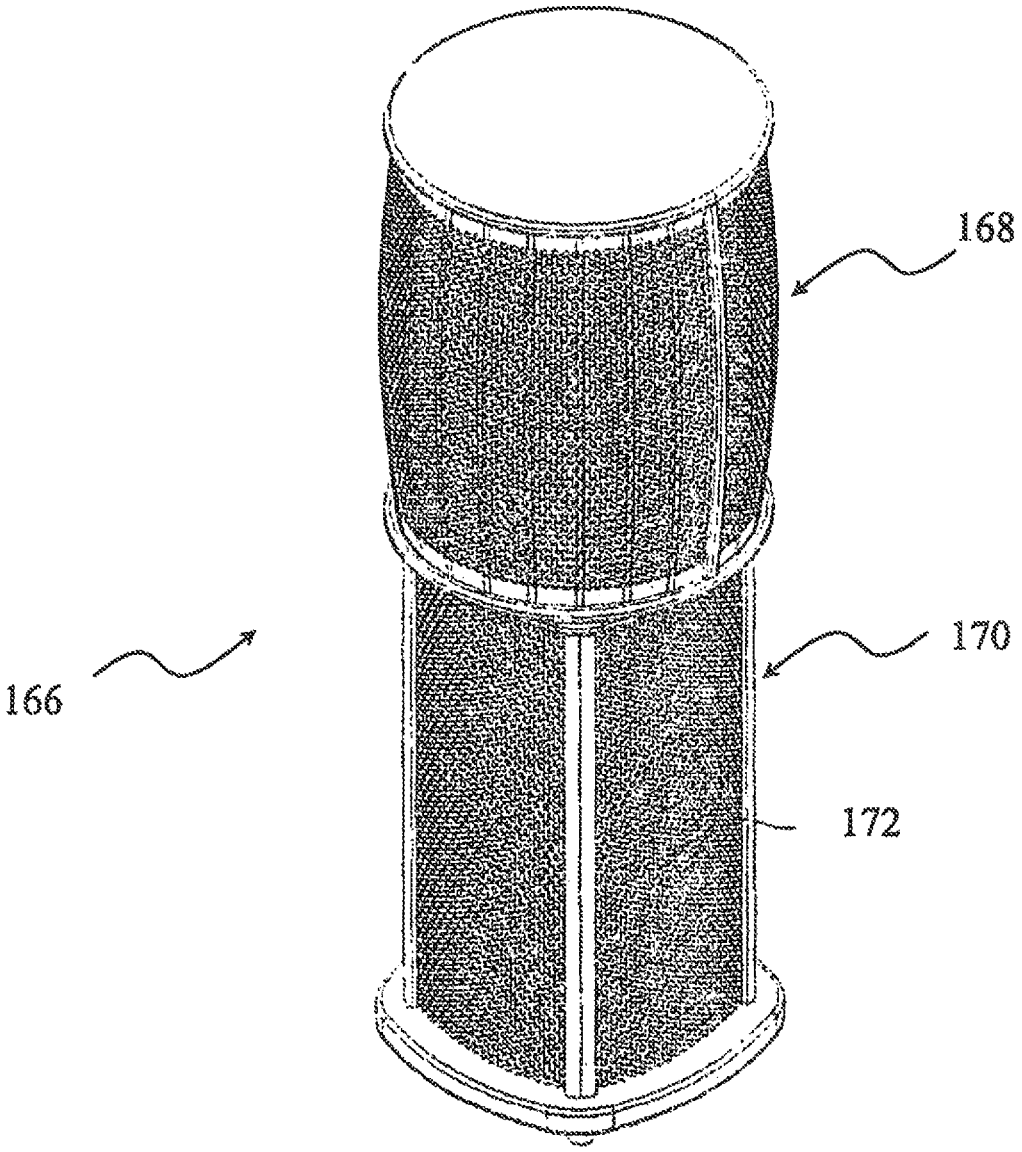
FIG. 15 shows a 360°-horizontal omni-directional hybrid ESL panel assembly with dynamic cone type woofers used to re-enforce the lower frequency range.

FIG. 15 illustrates an embodiment of a Hybrid ESL-360 loudspeaker 166 which radiates sound in all horizontal directions and also provides controlled dispersion in the vertical direction due to the curvature of the panel afforded by its barrel-type shape 168. The resulting radiated sound field maintains a uniform frequency response regardless of the horizontal position, and is thereby ideal for use in an open concept environment. Such a 360 degree dispersion ESL can be described as an omni-directional mono-polar radiator. Similar to FIG. 14, there is a supporting stand 170 that houses one or more woofers 172, arranged ideally in, but not limited to, a force neutral alignment.

Other arrangements of woofer are also possible and in no way limited to that of locating woofers above and/or below the ESL-360 assembly or integrating woofers inside the ESL unit to assist the movement of the acoustic film.

Figure 16:
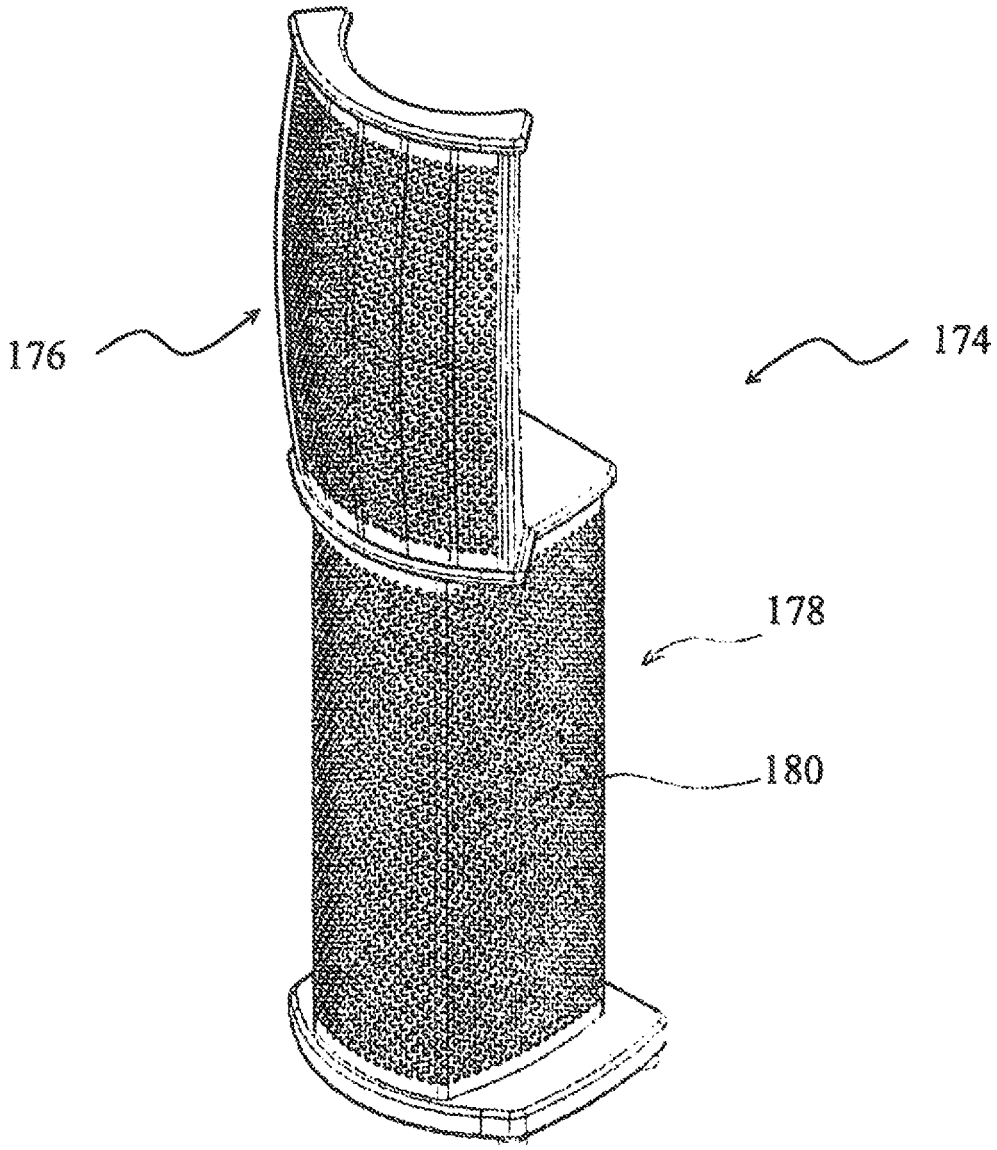
FIG. 16 shows a 90°-horizontal dispersion hybrid ESL assembly with dynamic cone type woofers used to re-enforce the lower frequency range.

FIG. 16 is an embodiment of a Hybrid ESL-90 loudspeaker 174 where the ESL panel 176 is shown as having a horizontal dispersion of approximately ninety degrees. In addition, there is a pedestal or stand 178 that contains one or more low frequency woofers 180. The panel radiates sound energy from both sides and thereby functions as a dipole radiator.

Figure 17:
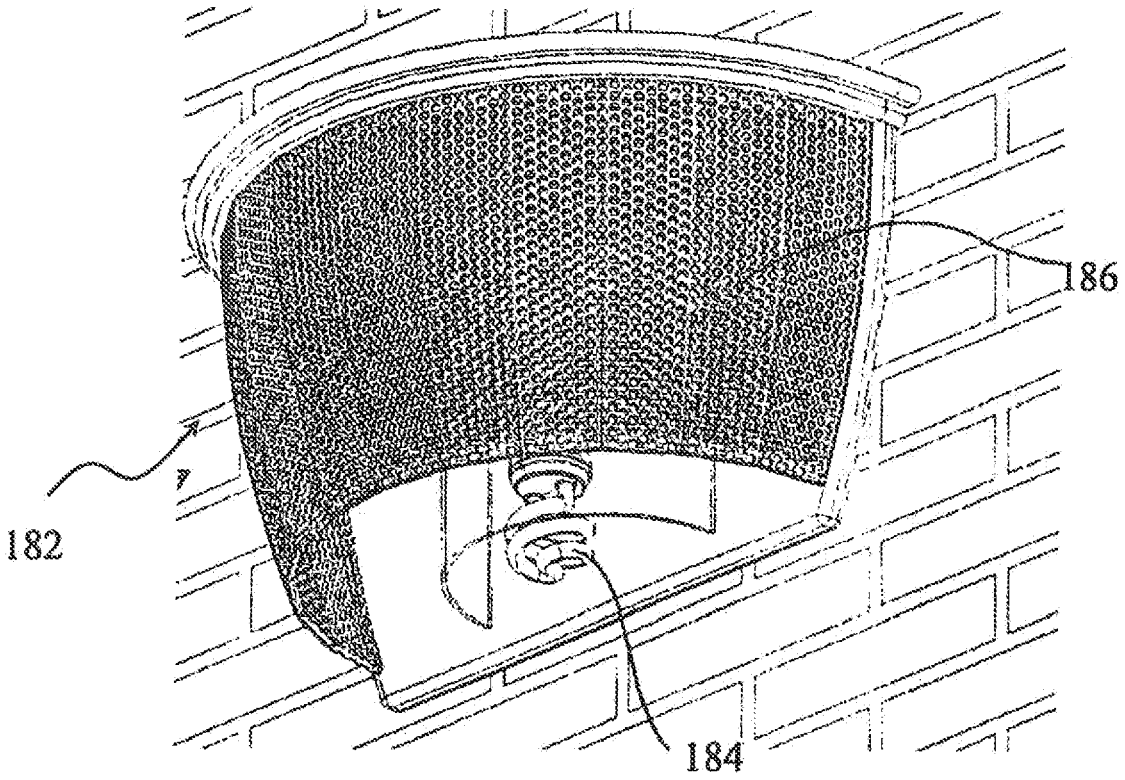
FIG. 17 shows a wall sconce lamp fixture which includes an ESL panel curved in two directions.

FIG. 17 illustrates a wall-mounted lighting sconce 182 having perforated panels (186) of the ESL as a shade for the lamp 184, with a fixed percentage of light transmission due to the apertures. The apertures in the inner and outer respective stator panels can either be aligned for maximum transmission of light or miss-aligned for lower light transmission and provision of shading. In the case of a sconce it may be desirable to have a panel 186 with significant curvature about a vertical axis to project a sound field onto a nearby seating area. In many cases, annealed material is a preferred technique for the maximization of material deformation capability. Although the apertures are shown as round it may be preferable to use an elongated aperture and or a punch pattern that is conducive to large deformations as may be required to realize various sconce type forms.

In some cases, the final stator form can be achieved by first partially stretching/forming the material, then subjecting it to a heat stress relieving cycle, followed by completion of subsequent stretching operations, in order to prevent tearing of the perforated material.

FIGS. 14 to 16 illustrate an option of using of a base or stand to support different configurations of an ESL assembly. In the implementation of a sconce 182 shown in FIG. 17 (or other architectural forms), it is understood that additional low frequency drivers may also be included and, therefore integrated within, or, external to the architectural form as required to achieve desired acoustic design goals.

Wherever ranges of values are referenced within this specification, sub-ranges therein are intended to be included unless otherwise indicated. Where characteristics are attributed to one or another variant, unless otherwise indicated, such characteristics are intended to apply to all other variants where such characteristics are appropriate or compatible with such other variants.

CONCLUSION

The foregoing has constituted a description of specific embodiments showing how the invention may be applied and put into use. These embodiments are only exemplary. The invention in its broadest, and more specific aspects, is further described and defined in the claims which now follow.

I claim:

1. A stator panel for an electrostatic loudspeaker, comprising:

(a) a rigid plate comprising an electrically conductive core, having a plurality of through holes covering main area of the rigid plate, wherein an edge of each through hole of the core is smoothed by removing the edge; and (b) an insulating coating formed on the rigid plate.

2. The stator panel as recited in claim 1, wherein the smoothed edge of the each through hole of the core is a rounded corner radius of at least 10% of the core thickness.

3. The stator panel as recited in claim 1, wherein the smoothed edge of the each through hole of the core has a rounded corner radius of at least 25% of the core thickness.

4. The stator panel as recited in claim 1, wherein the smoothed edge of the each through hole of the core has a rounded corner radius of at least 35% of the core thickness.

5. The stator panel as recited in claim 1, wherein the smoothed edge of the each through hole of the core has a rounded corner radius of at least 40% of the core thickness.

6. The stator panel as recited in claim 1, wherein the smoothed edge of the each through hole of the core is a beveled edge.

7. The stator panel as recited in claim 1, wherein the smoothed edge of the each through hold of the core is a chamfer.

* * * * *